US008960958B1

(12) United States Patent
Hsia et al.

(10) Patent No.: US 8,960,958 B1
(45) Date of Patent: Feb. 24, 2015

(54) SOLID-STATE LIGHTING TROFFER WITH READILY RETROFITTABLE STRUCTURE

(71) Applicant: Lightel Technologies, Inc., Renton, WA (US)

(72) Inventors: Chungho Hsia, Bellevue, WA (US); Pai-Sheng Shen, Bellevue, WA (US); Chunte Yu, Bellevue, WA (US)

(73) Assignee: Lightel Technologies, Inc., Renton, WA (US)

( * ) Notice: Subject to any disclaimer, the term of this patent is extended or adjusted under 35 U.S.C. 154(b) by 40 days.

(21) Appl. No.: 13/968,415

(22) Filed: Aug. 15, 2013

(51) Int. Cl.
*F21K 99/00* (2010.01)

(52) U.S. Cl.
CPC .... *F21K 9/17* (2013.01); *F21K 9/54* (2013.01)
USPC ..... 362/249.02; 362/297; 362/346; 362/349; 362/217.05; 362/225

(58) Field of Classification Search
USPC ..... 362/249.02, 297, 346, 347, 349, 225, 362/217.05
See application file for complete search history.

(56) References Cited

U.S. PATENT DOCUMENTS

| | | | | |
|---|---|---|---|---|
| 7,441,930 | B2 * | 10/2008 | Lin | 362/410 |
| 7,530,712 | B2 * | 5/2009 | Lin et al. | 362/247 |
| 7,841,738 | B2 * | 11/2010 | Engel | 362/235 |
| 8,287,153 | B2 * | 10/2012 | Leung et al. | 362/249.02 |
| 2010/0172152 | A1 * | 7/2010 | Boonekamp | 362/609 |
| 2011/0002682 | A1 * | 1/2011 | Messina | 396/200 |
| 2011/0032698 | A1 * | 2/2011 | Kim | 362/235 |
| 2011/0267839 | A1 * | 11/2011 | Kang et al. | 362/609 |

* cited by examiner

*Primary Examiner* — Laura Tso
(74) *Attorney, Agent, or Firm* — Han IP Corporation

(57) ABSTRACT

A light-emitting diode (LED) troffer adopts LED light sources mounted along two lengthwise sides of an LED module that uses a reflecting diffuser and a diffused light exit window to sufficiently average white light emissions from a plurality of LEDs or to properly mix light emissions from white LEDs at correlated color temperature (CCT) of 6,200±300 K with emissions from LEDs having saturated colors for uniform and tunable CCT light outputs having a consistent intensity or color hue within viewing angles. The troffer adopting a retrofittable design enables single person to readily hang and secure the LED module single-ended on top of the troffer for installation, retrofit, and inspection. The troffer uses such an integrated LED module with a power density less than 0.0127 W/cm$^2$, and thus no apparent heat sink is needed.

32 Claims, 15 Drawing Sheets

SOLID-STATE LIGHTING TROFFER WITH READILY RETROFITTABLE STRUCTURE

BACKGROUND OF THE INVENTION

1. Field of the Invention

This invention relates to a light-emitting diode (LED) troffer, and more particularly to a readily retrofittable LED troffer that adopts LED light sources mounted along two lengthwise sides of an LED module and a reflecting diffuser used to sufficiently mix and uniform light emissions from various LED light sources with consistent intensity and color hue within viewing angles and improved aesthetic perception.

2. Description of the Related Art

Solid-state lighting from semiconductor light-emitting diodes (LEDs) has received much attention in general lighting applications today. Because of its potential for more energy savings, better environmental protection (with no hazardous materials used), higher efficiency, smaller size, and longer lifetime than conventional incandescent bulbs and fluorescent tubes, the LED-based solid-state lighting will be a mainstream for general lighting in the near future. Meanwhile, as LED technologies develop with the drive for energy efficiency and clean technologies worldwide, more families and organizations will adopt LED lighting for their illumination applications. In this trend, more energy saving, more efficient correlated color temperature (CCT) tunability, and more aesthetic perception in lighting quality have become especially important and need to be well addressed.

In a retrofit application of a linear LED tube lamp to replace an existing fluorescent tube, the lamp is so configured that the light coming out from the LED light sources illuminates a target area directly. The shortcomings are pixelation, glare, and not enough cut-off at vertical angles greater than 80° above the lamp nadir, which cause users' eyes uncomfortable, thus affecting their mood. Similarly, many conventional LED troffers adopt direct illumination approach and show a poor lighting quality such as hot and dark spots and shadows.

Cree in its design patents, U.S. D667,983 S and D673,711 S, proposes a front-mounted LED approach that uses single linear high-brightness LED array in the middle of the luminaire/troffer (troffer hereafter), shining a reflector and indirectly illuminating a target area. In this case, the back side of the LED mounting surface is thus a heat sink, which faces downward, and the user can see the radiation-like fins of the heat sink in the middle of the troffer. Thus, the design not only looks unaesthetic but shows a dark stripe in the central region. Moreover, because the heat dissipation area of the heat sink is limited, a heat sink with fins must be used to efficiently dissipate the heat generated by operating LEDs, or premature failure of the LEDs occurs. Such kinds of design are expensive because an extra heat sink with heat-dissipation fins is needed. Furthermore, their thermal performance is far from ideal because heat goes up, but the heat sink with fins is in the opposite downward direction, thus affecting convective heat transfer in ambient air.

A conventional 2 by 2 feet panel light troffer uses a square thick acrylic plate as a light diffusing medium. LED light sources located at four lateral sides of the acrylic plate illuminate the four sides of the plate, and evanescent light waves exiting from the front face of the acrylic plate further scatter through a plastic diffuser attached to the acrylic plate in the front panel before launching into a target area. In order to increase optical efficiency, the back panel of the panel light troffer is attached with a reflective sheet. However, such panel light troffers have their light opening flushed with T-bar ceiling grids without recess. Thus, occupants in the room can see the whole bare bright area 2 by 2 feet and feel uncomfortable because a direct glare affects their eyes and distracts them.

In today's lighting applications, correlated color temperature (CCT) tuning is important. Although consumers demand a tunable CCT such as warm-white at 2,700 K, sun-white, natural-white, or cool-white at 6,200±300 K in lighting to help improve the atmosphere in working, exhibiting, or living areas, there have been very few such lighting products in the troffer and luminaire markets. The LED panel light troffers do not have a proper structure to sufficiently perform spatial color mixing, which makes it difficult for them to be successful on the market. Instead, manufacturers can generally make an LED troffer using two kinds of phosphor coated white LEDs, one cool white and the other warm white, to mix the light emissions with different ratios to come up with desired color temperatures. Because at the two color extremes, only one kind of LEDs emits the light, such troffers have poor cost efficiency and luminous efficacy. In spite of these disadvantages, the approach is one of several solutions to changing CCT of an LED troffer in general lighting applications. However, the approach needs a proper color mixing scheme to smooth out lighting outputs such that the color hue is consistent within viewing angles.

Other possible color temperature tuning approaches include a white LED at CCT of 6,200±300 K mixed with an LED having a saturated color, featuring high luminous efficacy; a yellow white LED mixed with a red LED; and RGB color mixing, the earliest approach to varying light color, in which white light is perceived where all three additive primaries overlap. Because of low luminous efficacy and difficulty to meet CIE 1931 recommendations for general lighting in solid state lighting products, such as stabilizing a specific chromaticity over time while LED junction temperatures change from ambient temperature to 120° C. or higher due to different thermal dependencies for an individual LED, the RGB approach is seldom adopted as in general lighting applications today. However, in decorative lighting, RGB color mixing is frequently used. By varying the intensities of the individual red, green, and blue light sources, any colors that human eyes can perceive can be obtained. Surely, in all of the above mentioned CCT tuning approaches, many of same or different LEDs need to be used in combination to achieve a required lumen output. Thus uniformity of the resultant CCT light and color hue within viewing angles becomes an issue if the troffer used cannot provide adequate light averaging and mixing functions.

As LED technologies and standards continue to develop rapidly, today's 2 by 4 troffer requirements of an LED luminous efficacy of 65 lumens per watt and a color rendering index (CRI) of 80 will become unsatisfactory tomorrow to consumers and the Energy Star program. Market also requires minimum lumens emitted from an LED troffer and a specific CCT tolerance for LED chips. For example, today's minimum requirement of 4,000 lumens in a 2 by 4 LED troffer and a CCT tolerance of 175 K may be obsolete tomorrow. Similarly for LED drivers, today's requirements of a power factor of 0.9, a total harmonic distortion (THD) less than 20%, and a power consumption of 50 W may not be good enough tomorrow for energy firms to offer energy rebates, a great incentive for consumers and organizations to adopt LED troffers. In this case, outdated LED modules and LED drivers in LED troffers may need to be removed and replaced with upgraded ones to meet updated consumer needs and new standards. To retrofit a conventional LED troffer for replacing an existing LED driver or LED module, however, is not easy because one must first remove the whole troffer from T-bar ceiling grids. It is especially true when a troffer with a dimension of 2 by 4 feet is quite heavy and when one person alone is less likely to remove such a troffer from at least nine-foot high ceiling.

Emergency lighting is especially important in this consumerism era. The emergency lighting systems in retail sales and assembly areas with an occupancy load of 100 or more are required by codes in many cities. Occupational Safety and Health Administration (OSHA) requires that a building's exit paths be properly and automatically lighted at least ninety minutes of illumination at a minimum of 10.8 lux so that an employee with normal vision can see along the exit route after the building power becomes unavailable. This means that emergency egress lighting must operate reliably and effectively during low visibility evacuations. To ensure reliability and effectiveness of backup lighting, building owners should abide by the National Fire Protection Association's (NFPA) emergency egress light requirements that emphasize performance, operation, power source, and testing. OSHA requires most commercial buildings to adhere to the NFPA standards or a significant fine. Meeting OSHA requirements takes time and investment, but not meeting them could result in fines and even prosecution. If a building has egress lighting problems that constitute code violations, the quickest way to fix is to replace the existing troffer with a multi-function LED troffer that has an emergency light package integrated with the normal lighting. The code also requires the emergency lights be inspected and tested to ensure they are in proper working conditions at all times.

It is, therefore, the manufacturers' responsibility to design a readily retrofittable LED troffer with an emergency lighting package integrated such that after the LED troffer is installed on a ceiling, the LED module can be individually removed from the LED troffer, or the emergency lighting package associated with the LED module can be inspected on site without removing the whole troffer from the ceiling. The retrofittable design can greatly reduce lifetime cost of ownership. Currently no manufacturers have adopted the idea in an architectural troffer used to replace conventional fixtures for fluorescent lamps.

FIGS. 1 and 2 show the design in Cree's design patents, U.S. D667,983 S and D673,711 S. An LED troffer 100 comprises a housing 110 served as a mounting frame and an LED module 140 connected and fixed to the housing 110. In the middle of LED module 140 is a heat sink 141 with fins, which shows a dark stripe area when LED photons emitting from LEDs (not shown) mounted backside of the heat sink 141 are reflected from a back-reflector (not shown) and strike two exit windows 145 and 146 on the two sides of the heat sink 141, making them bright. The LED module 140 is mounted and fixed on top of the housing 110 when the LED troffer 100 is normally installed on T-bar ceiling grids. Thus, the LED module cannot be removed from the bottom side in the service location without first removing the whole LED troffer 100. Furthermore, installing such a troffer on T-bar ceiling grids cannot be done by just one person because it is too heavy and has a dimension of 2 by 4 feet. Installation cost becomes an issue.

FIG. 3 is a typical panel light used in troffer applications. FIG. 4 is an expanded view of a part of the prior art LED panel light troffer in FIG. 3. Referring to FIGS. 3 and 4, an LED panel light troffer 200 comprises a square frame 210 with a light exit window 215 in the central square portion enclosed by the frame 210 and an LED module 220 embedded inside the frame 210. In FIG. 4, the LED module 220 comprises four LED arrays 230 mounted in four sides of the square frame 210. A plurality of LEDs 206 in each of the LED array 230 (only two shown in this corner) are mounted on a plane 90° with respect to the light exit window 215. In the back of the light exit window 215 is a thick acrylic plate, whereas in the further back is a reflective film (not shown). The emitted photons from the LEDs 206 launch into four lateral sides 240 of the thick acrylic plate. Part of photons strike the reflective film, reflect back to the acrylic plate, and exit through the light exit window 215. Rest of photons emit directly from the light exit window at various inclined angles. Because the LED module 220 is embedded inside the frame 210, there is no way to remove the LED module 220 and to replace it without first removing the whole panel light troffer 200 from T-bar ceiling grids and then disassembling it to a component level. Although a square panel light troffer is illustrated here, a rectangular one is also available.

SUMMARY OF THE INVENTION

This invention relates to light-emitting diode (LED) troffers that adopt LED light strips mounted along two lengthwise sides of an LED module that uses a reflecting diffuser to sufficiently average light emissions from a plurality of white LEDs or integrated RGB LEDs mounted on the LED light strips without dark or hot spots and shadow appeared on a light exit window. In another embodiment, such a troffer uses a reflecting diffuser to sufficiently mix light emissions from white LEDs having a CCT at 6,200±300 K and color light emissions from LEDs having saturated colors to generate tunable CCT light outputs. The reflecting diffuser is so designed that most of the light emissions from LEDs launching to the reflecting diffuser encounter a single reflection before reflecting downward at large inclined angles to strike the light exit window whereas small part of the light emissions launch directly to the light exit window. In combination, the resultant light distribution on the light exit window becomes uniform with more consistent intensity and color hue within viewing angles.

The LED troffer adopts a retrofittable structure comprising four spring-loaded pins on the LED module and four enhanced slots on a troffer base mount. When the pins couple with the enhanced slots, the LED module can be easily mounted and secured on top of the troffer base mount which can be mounted alone on T-bar ceiling grids in advance, from the bottom side. The mechanism of the spring-loaded pins and the enhanced slots also enables single person to readily hang and mechanically secure the LED module single-ended on the troffer base mount in a way that she or he can do the work for installation, retrofit, inspection, and testing of the LED module. The troffer base mount used in the bottom of the LED troffer to further reduce glare and improve cut-off is thermally connected to the LED module that has a continuous structure of a body having LED mounting surfaces and reflectors. Such an LED module has a power density less than 0.0127 W/cm$^2$, and thus no apparent heat sink is needed. Other advantages include cost reduction and aesthetic perception improvement.

In another embodiment, an additional linear LED light strip is further used as an emergency light in the central elongated region of the reflecting diffuser, illuminating directly downward to a target area in a building through the same light exit window as used in the normal light. The emergency light strip concealed in the troffer will be lighted only when the AC power to the building is unavailable. The multi-function design integrated normal and emergency light systems in an LED troffer, sharing a common optical system, not only saves space but also increases aesthetic perception of emergency light.

DETAILED DESCRIPTION OF THE INVENTION

Figure 1:
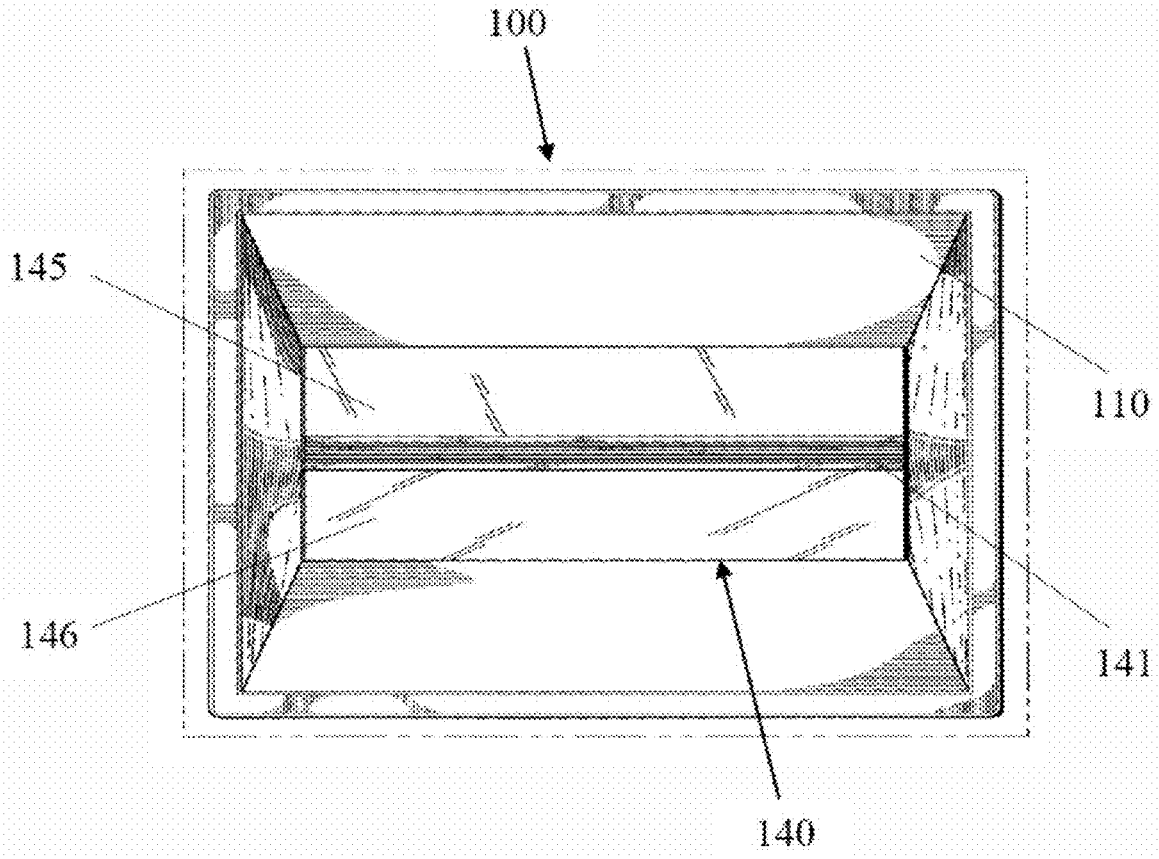
FIG. 1 PRIOR ART
FIG. 1 is an illustration of a prior art LED troffer.
Figure 2:
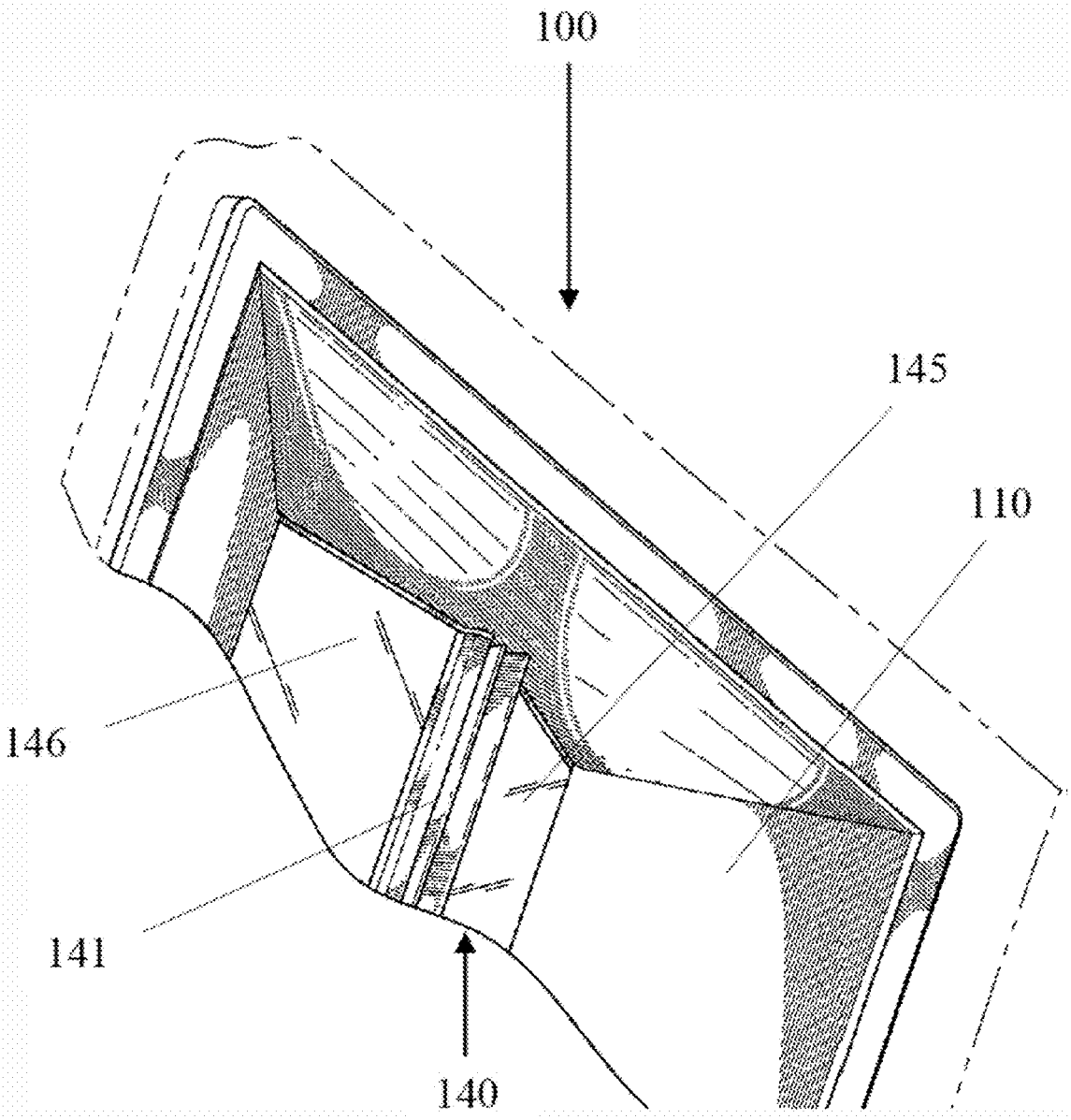
FIG. 2 PRIOR ART
FIG. 2 is an illustration of a heat sink with fins in the prior art LED troffer in FIG. 1.
Figure 3:
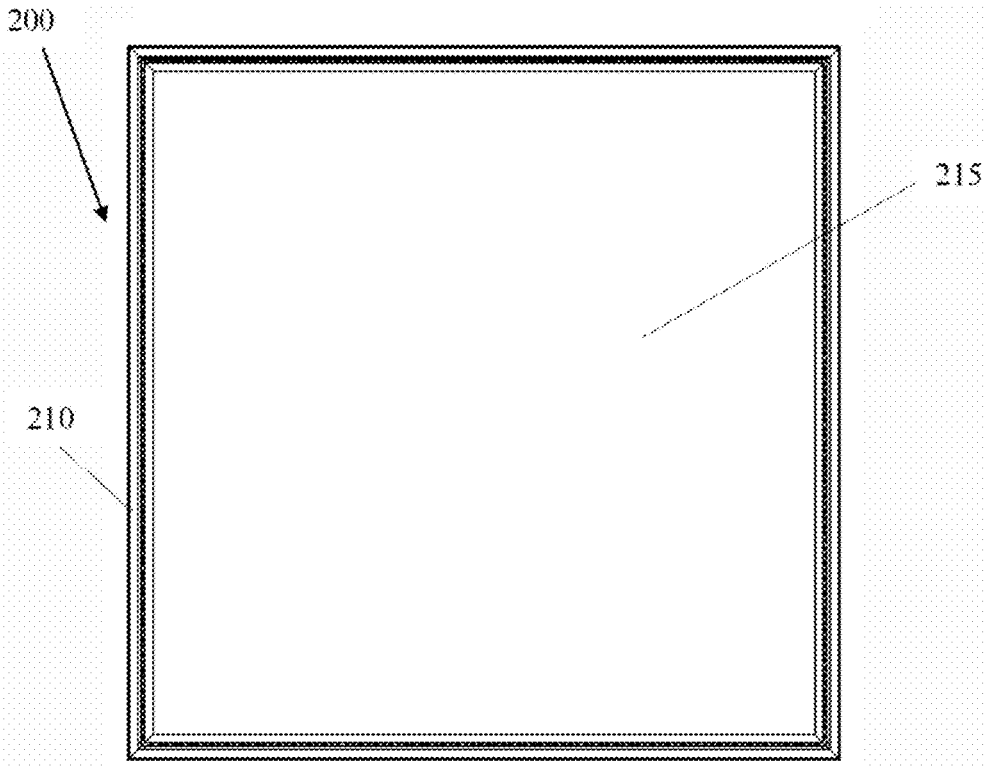
FIG. 3 PRIOR ART
FIG. 3 is an illustration of a prior art LED panel light troffer.
Figure 4:
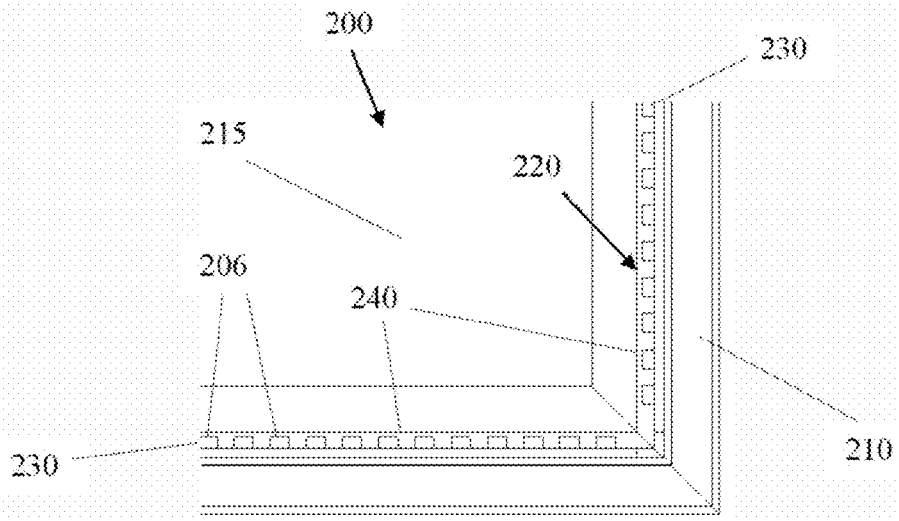
FIG. 4 PRIOR ART
FIG. 4 is an expanded view of a part of the prior art LED panel light troffer in FIG. 3.
Figure 5:
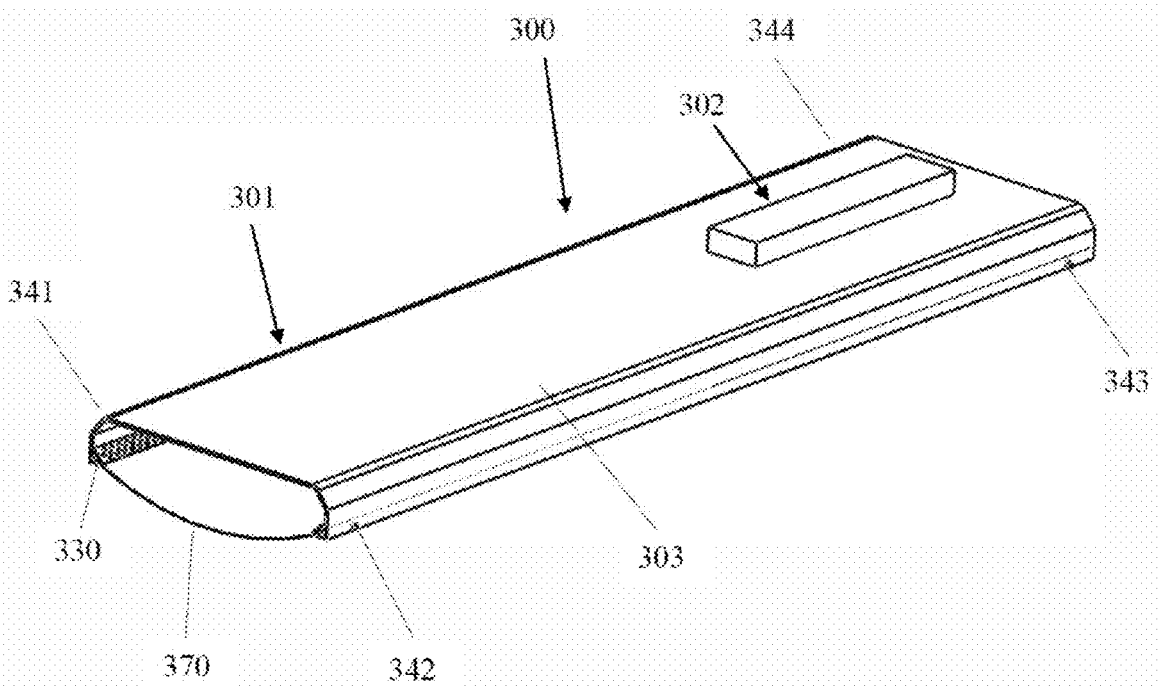
FIG. 5 is an LED light engine according to the present invention.
Figure 6:
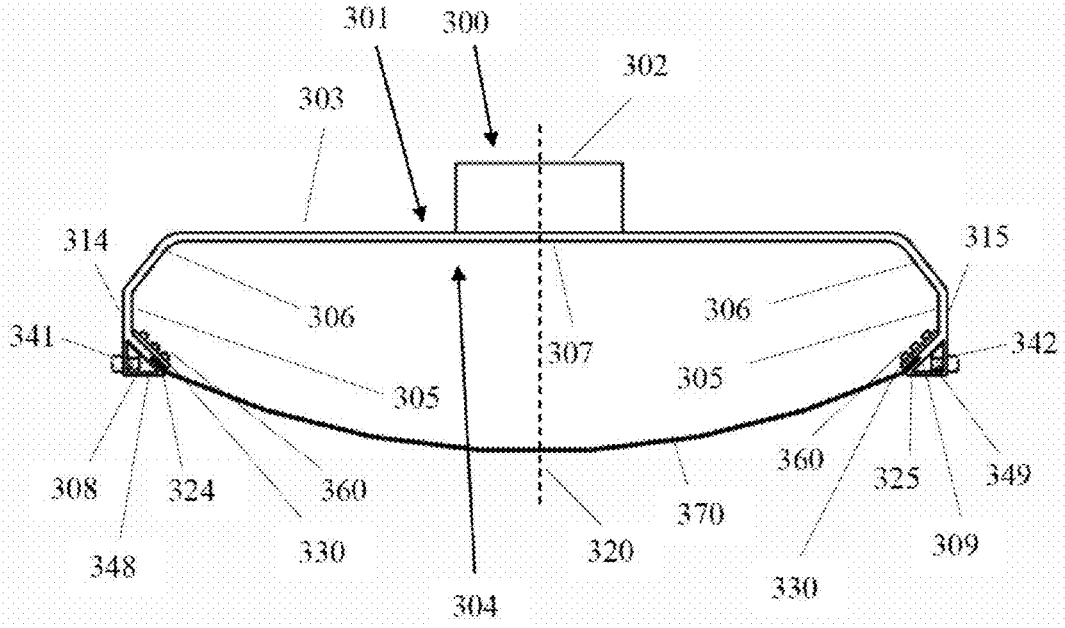
FIG. 6 is a front view of an LED light engine.

FIG. 5 is an LED light engine 300 according to the present invention. FIG. 6 is the front view of the LED light engine 300. Referring to FIGS. 5 and 6, the LED light engine 300 comprises an LED module 301 and an external driver 302. The external driver 302 may or may not be mounted on the LED module 301, although it is so shown. In other words, the external driver 302 should not be limited to this configuration only. The LED module 301 comprises an elongated body 303 comprising a reflector 304 on a surface thereof, the body having two side surface portions 314 and 315; two flat mount surface portions 324 and 325 symmetrically arranged about a central vertical plane 320, respectively connecting to the side surface portions 314 and 315 of the elongated body 303; two LED light strips 330 respectively mounted on the two flat mount surface portions 324 and 325, facing the reflector 304 with an angle less than 90° but greater than 0° as measured from their respective normal lines, each of the LED light strips 330 having a plurality of LEDs 360 thereon; and a light exit window 370 having a convex shape, wherein the reflector 304 of the elongated body 303, the two flat mount surface portions 324 and 325, and the light exit window 370 define an interior cavity. The reflector 304 in the LED module 301 comprises an imperfect reflecting diffuser with a white reflection material that has 8% absorption or less. From the two side surface portions 314 and 315 protrude four pins 341, 342, 343 and 344. The pins 343 and 344 that are close to the external driver 302 are used to hang the LED light engine 300 single-ended on a troffer base mount 400 (shown in FIGS. 12 and 13) during LED troffer installation.

The reflector 304 further comprises two vertical reflectors 305 on the two side surface portions 314 and 315, two angled side reflectors 306 respectively connected to the two vertical reflectors 305, and a top reflector 307 connected in between the two angled side reflectors 306, wherein the two vertical reflectors 305 are symmetric about the central, vertical plane 320, so as the two angled side reflectors 306. Unlike some prior art devices that need multiple reflections to uniform the beams emitted from multiple light sources, the LED module 301 according to the present invention is so designed that 95% of the luminous flux in all directions emitted from the LEDs 360 encounter only one reflection from any of the two vertical reflectors 305, the two angled side reflectors 306, and the top reflector 307 to increase optical efficiency, while maintaining the uniformity better than 3:1, or even 2:1. The combined structure of the side-mounted LEDs and the reflectors 305, 306, and 307 ensures the mixing distance to be effectively doubled or tripled and the surface area of the reflected beams to be increased so as to well perform light averaging for multiple same or different white LEDs or multiple integrated RGB LEDs, or color mixing of white LEDs with color LEDs for a tunable white light. Besides, the luminance is modified from bright, uncomfortable point sources to a much larger, softer diffused light. The reflecting diffuser further provides a uniform and pleasant luminous appearance on the light exit window 370. Thus, a coarse luminance gradient worse than 10:1 in a conventional direct-illumination luminaire that requires heavy diffusers to improve can be coped with much less aggressive diffusers achieving max/min ratios of 3:1, or even 2:1. Although the reflector 304 in FIG. 6 comprises two vertical reflectors 305, two angled side reflectors 306, and one top reflector 307, the reflector 304 used in the LED module should not be limited to this configuration only. For example, the two angled side reflectors 306 may comprise multiple sub-reflectors. The reflector 304 may be formed by a single or multiple concave shapes.

In FIGS. 5 and 6, the reflectors 305, 306, and 307 comprise a diffuser with a white reflective material that has 8% absorption or less. One way to achieve this is by using a reflective coating with a white paint mixed with a strongly reflective powder that has a refractive index greater than 1.9. The interior of the reflectors 305, 306, and 307 adopting this coating shows features of a nearly ideal reflecting diffuser. The light exit window 370 may comprise a diffuser with volumetric material, a prismatic lens structure, or a lens with diffraction gratings, a random or regular geometric pattern, or simply a frosted diffusive inlay on the interior of the light exit window.

The structure of the side-mounted LEDs in the LED module 301 has another advantage. As mentioned, the two LED strips 330 are side-mounted on the two flat mount surface portions 324 and 325, which continuously connect to the two vertical reflectors 305, the two angled side reflectors 306, and the top reflector 307 in series, thus forming a large area for efficiently dissipating the heat generated by operating LEDs. Based on power consumption and available heat dissipation area on the LED module 301, a power density of the LED module 301 can be calculated to be less than 0.0127 W/cm$^2$, and thus no apparent heat sink is needed.

Figure 7:
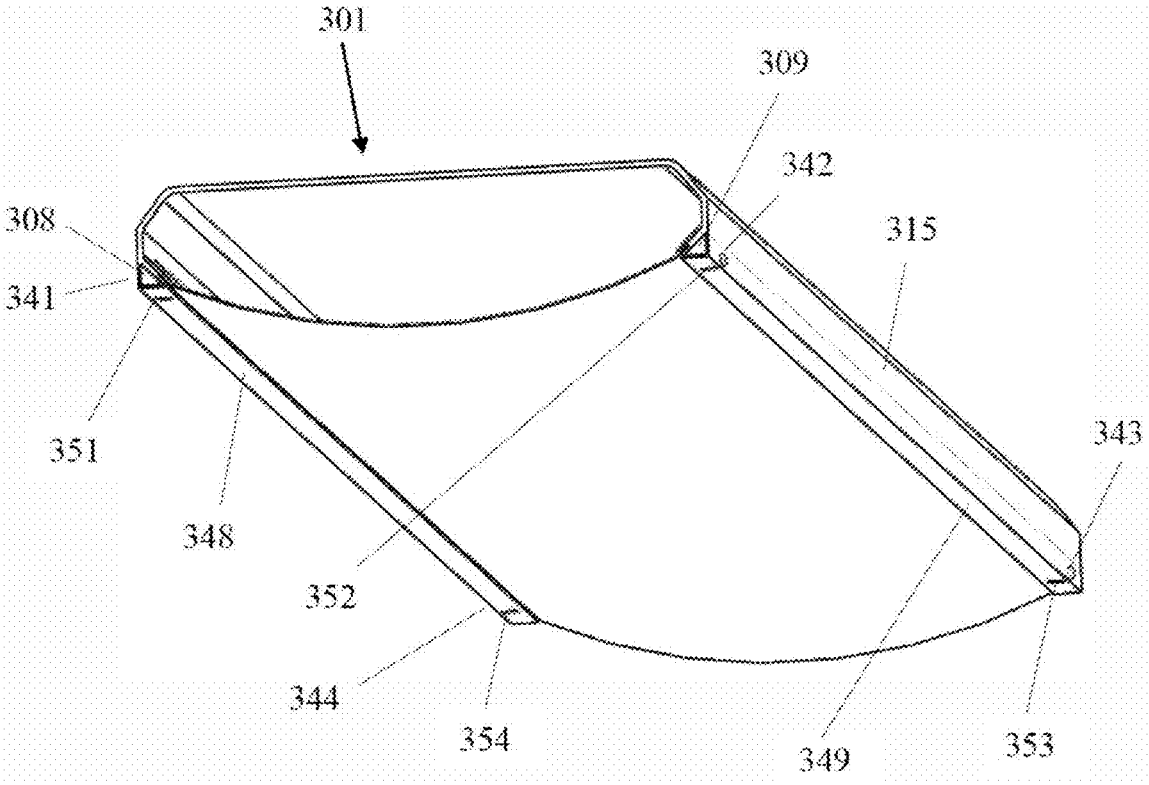
FIG. 7 is a front-bottom perspective view of an LED light engine.
Figure 8A:
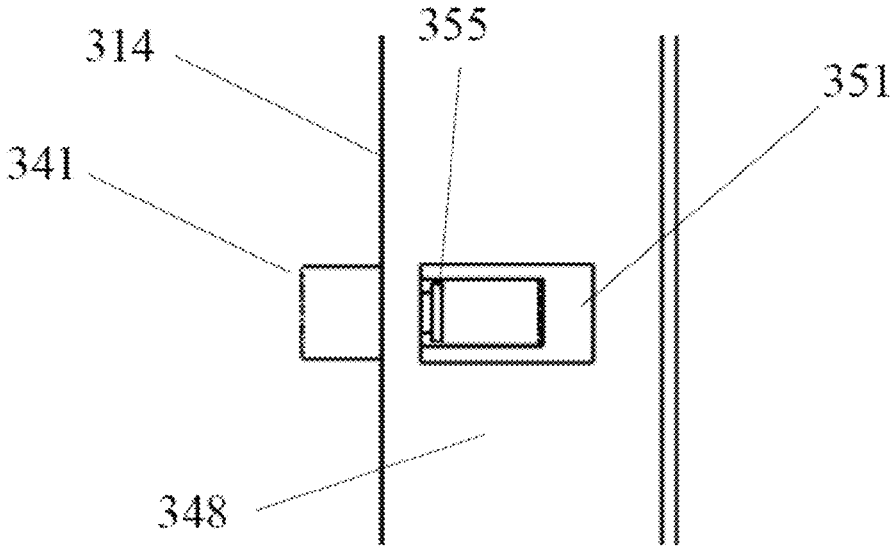
FIG. 8A is a pin-control plate used in a spring-loaded pin assembly when the spring is in an equilibrium state.
Figure 8B:
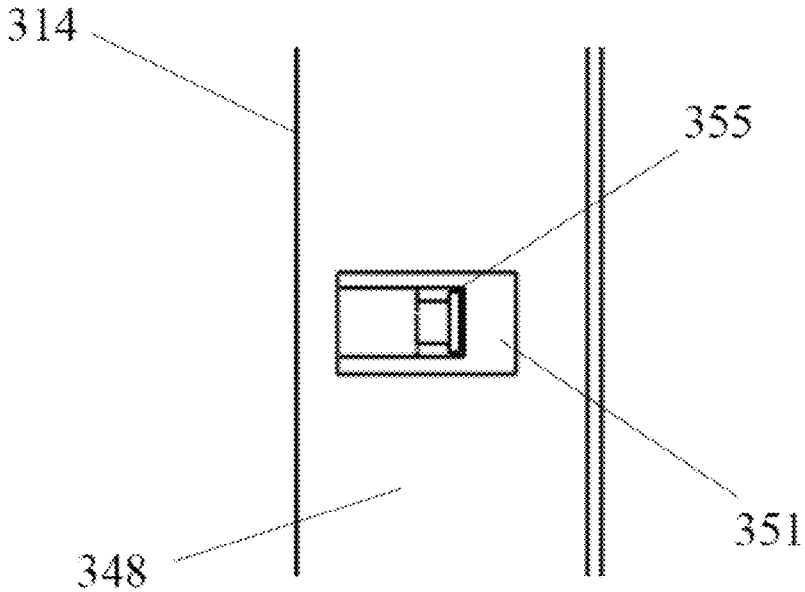
FIG. 8B is a pin-control plate used in a spring-loaded pin assembly when the spring is in a compressed state.

FIG. 7 is a front bottom perspective view of the LED light engine 300. Referring to FIGS. 6 and 7, the pins 341, 342, 343, and 344 are spring-loaded, meaning that each of the four pins can be pushed inwards by an external force such that the spring is compressed to a deformed length (a compressed state), and thus a small amount of energy is stored in the spring. When such a force no longer exists, the stored energy in the spring is released, and a spring force exerted to recover the spring to its free length (an equilibrium state) pushes the pin outwards. Such a spring length change mechanism helps an installer readily not only hang the LED light engine 300 on the troffer base mount 400 from the bottom side but also remove the LED light engine 300 from the troffer base mount 400, as will be explained below. On the two elongated sides, there exist two hollow triangular compartments 308 and 309, one 308 enclosed by three associated back sides of the side surface portion 314, the flat mount surface portion 324, and a bottom surface 348; and the other 309 enclosed by three associated back sides of the side surface portion 315, the flat mount surface portion 325, and a bottom surface 349. As shown, the bottom surface 348 is at a right angle with respect to the side surface portion 314 whereas the bottom surface 349 is at a right angle with respect to the side surface portion 315. Four spring-loaded pin assemblies that respectively comprise the pins 341, 342, 343, and 344 are inserted in the two hollow triangular compartments 308 and 309 near four corners (shown in FIG. 7). On the two bottom surfaces 348 and 349, four access slots 351, 352, 353, and 354 relative to the four pins 341, 342, 343, and 344 are used for an installer to access an associated pin-control plate 355 (in FIGS. 8A and 8B) used to move the pins inwards so that the end surfaces of the four pins 341, 342, 343, and 344 are flush with the side surface portions 314 or 315, depending upon which side the pins are in. Take the pin 341 as an example. In FIG. 8A, the pin 341 protrudes the side surface portion 314 because the spring used in its spring-loaded pin assembly is in its equilibrium state; no external force is applied thereon. The access slot 351 on the bottom surface 348 exposes the pin-control plate 355. Referring to FIG. 8B, an uninstaller can move the pin-control plate 355 to the right such that the end surface of the pin 341 is flush with the side surface portion 314 for uninstalling the LED light engine 300.

Figure 9:
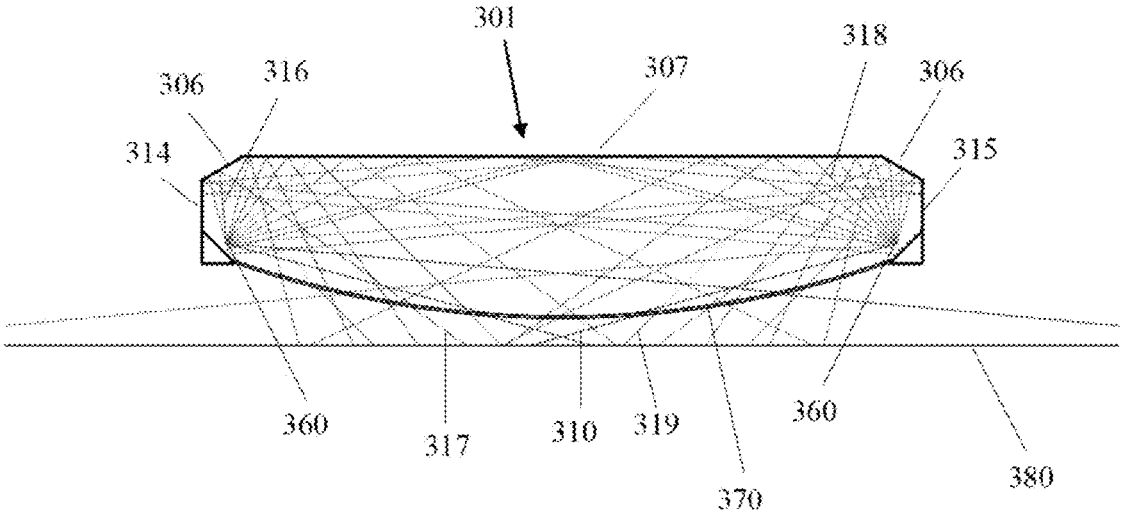
FIG. 9 is ray tracing results of an LED module according to the present invention.

FIG. 9 is ray tracing results for the LED module 301. The photons emerging from the surface-mount LED 360 have an angular distribution between $\theta=0$ and $\theta=\pi/2$. The distribution has a Lambertian form $I_{ph}=I_o \cos\theta$, where $I_o$ is photometric intensity (Im/Sr) in the normal direction, and $\theta$ is the angle from the emission-plane normal. Photons emerge normally through an exit surface with the highest probability and thus have maximum intensity. The photometric intensity in any direction then varies as the cosine of the angle between that direction and the normal to the surface. When such distributions follow Lambert's law, a diffuse emission or a diffuse reflection takes place, depending on whether the surface is emitting or reflecting. The far-field radiation pattern from a surface-emitting LED is similar to that from a Lambertian radiator; the intensity varies as $\cos\theta$. The intensity at $\theta=60°$ decreases to half its maximum value at $\theta=0°$.

To uniform the intensity from a single LED or multiple LEDs in a limited space, one must change the launching angle of each ray on the light exit window such that rays from the single LED or multiple LEDs overlap sufficiently. In FIG. 9, the LEDs 360 in the LED module 301 are side-mounted at an angle 135° and −135° with respect to the side surface portions 314 and 315. A primary ray 318 at 0° relative to the normal of LED mounting surface with the largest intensity emitted from the LED 360 launches to the top reflector 307 and its secondary reflected ray 319 strikes the light exit window 370 in the central area whereas a primary ray 310 at 60° with only half the intensity of the ray 318 directly launches to the light exit window 370 almost in the same location as the secondary reflected ray 319. In FIG. 9, an absorber 380 is used for ray tracing purpose only. A primary ray 316 at 50° with 64% of the largest intensity emitted from the LED 360 launches to the angled side reflector 306, and its secondary reflected ray 317 strikes the light exit window 370 near the central area. Other primary rays between the angle 0° and 60° relative to the normal of the LED mounting surface launch to the associated reflectors 306 and 307, and their secondary rays strike the light exit window 370 in brink area. This way, the resultant intensity becomes uniform, and no dark or hot spots can be seen. For simplicity, the ray tracing results shown in FIG. 9 only consider reflections from the top reflector 307 and the angled side reflector 306. In fact, the top reflector 307, the two angled side reflectors 306, and the two vertical reflectors 305 (in FIG. 6) provide not only reflection but diffusion functions because the distributions of photons reflected from those reflective surfaces follow Lambert's law, and the reflective surfaces are called Lambert surfaces, and the reflectors themselves are so called reflecting diffusers. The diffuser function of the reflectors used will help further mix the light emissions from multiple LED sources. In addition, the light exit window 370 can also have diffuser property. In this case, numerous primary rays and their secondary diffused rays from a plurality of LED light sources side-mounted overlap and mix sufficiently before launching to the light exit window 370 at large inclined angles, thus further helping keep the uniformity better than 3:1.

Figure 10:
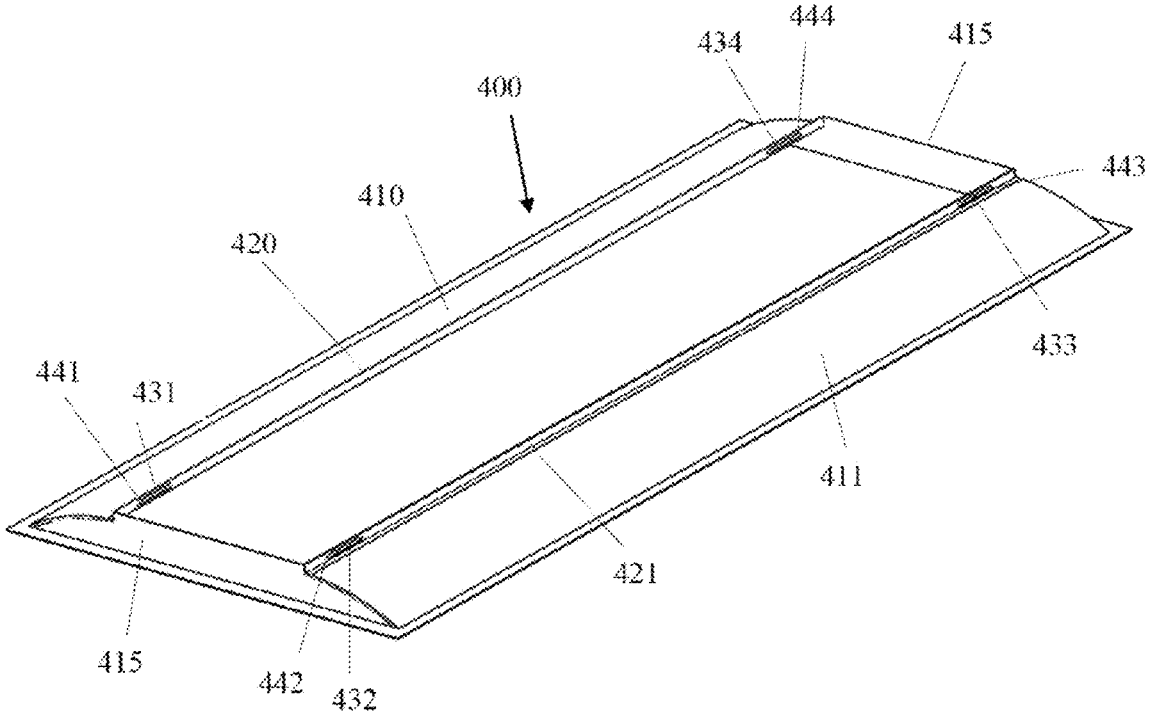
FIG. 10 is a troffer base mount according to the present invention.
Figure 11:
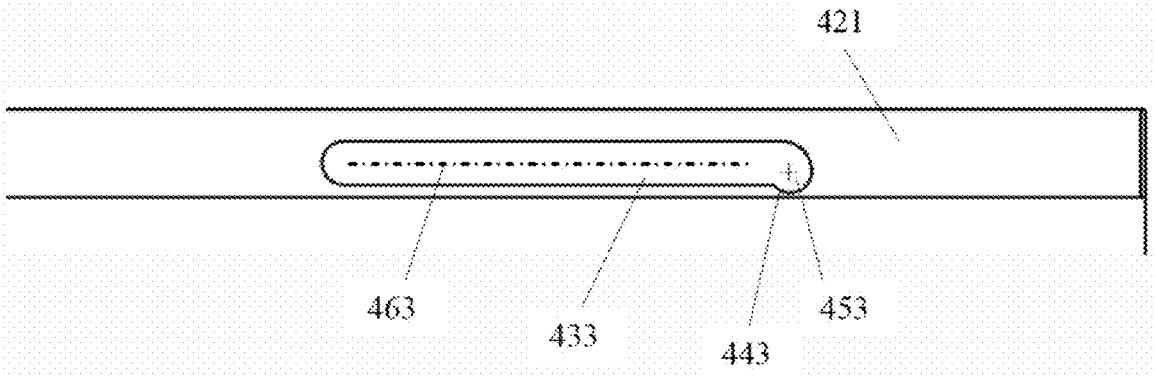
FIG. 11 is an expanded view of an enhanced slot on a troffer base mount according to the present invention.

In FIG. 10, the troffer base mount 400 comprises two side reflective portions 410 and 411, two vertical reflective portions 415 (only one facing reader shown), and two vertical walls 420 and 421 extending from the two side reflective portions 410 and 411, respectively. The two side reflective portions 410 and 411, symmetric about a vertical central plane (not shown) between them and located along two elongated sides, are used to further reflect those photons emitted from the LED module 301 and scattered from the light exit window 370 so as to improve perception of cut-off. The two side reflective portions 410 and 411 and two vertical reflective portions 415 are connected to form an upper first opening and a lower second opening with the first opening smaller than the second opening. FIG. 11 is an expanded view of an elongated slot 433 and a through hole 443 on the troffer base mount 400 according to the present invention. Referring to FIGS. 10 and 11, on the two vertical walls 420 and 421, there are four enhanced slots that comprise four elongated slots 431, 432, 433, and 434 respectively connected to four through holes 441, 442, 443, and 444 at the end of each elongated slot toward two ends of each of the two vertical walls 420 and 421, used for securing the LED light engine 300 in a way that the four pins 341, 342, 343 and 344 on the LED light engine 300 are coupled with the four through holes 441, 442, 443, and 444, respectively. In FIG. 11, the elongated slot 433 has a shape with its width smaller than its length. At the end of the elongated slot 433 toward the end of the vertical wall 421 in the troffer base mount 400 is the through hole 443 having a diameter slightly larger than the width of the elongated slot 433 and a center 453 lower than the center line 463 of the elongated slot 433. The elongated slots 431, 432, and 434 near other corners of the troffer base mount 400 have the same configuration as in the elongated slot 433. The structure of the elongated slots 431, 432, 433, and 434 provides enough mounting tolerances and helps a single installer efficiently hang one end of the LED light engine 300 on the troffer base mount 400 from the bottom side and do retrofit work. The through holes 441, 442, 443, and 444 at the end of each of the elongated slots 431, 432, 433, and 434 are used to accommodate and rest the pins 341, 342, 343 and 344, respectively.

As mentioned, installing the entire LED troffer on T-bar ceiling grids is a tough job, especially for one person. But if the LED troffer is separated into two parts, the troffer base mount 400 and the LED light engine 300, the installation job will be easier. One first installs the troffer base mount 400 on T-bar ceiling grids, then hangs one end of the LED light engine 300 on the troffer base mount 400 by coupling two pins (341/342 or 343/344) with two through holes (441/442 or 443/444) and does a proper wiring, and lastly raises the LED light engine 300 to the horizontal position such that the two remaining pins on the LED light engine 300 are coupled with the two remaining through holes.

Figure 12:
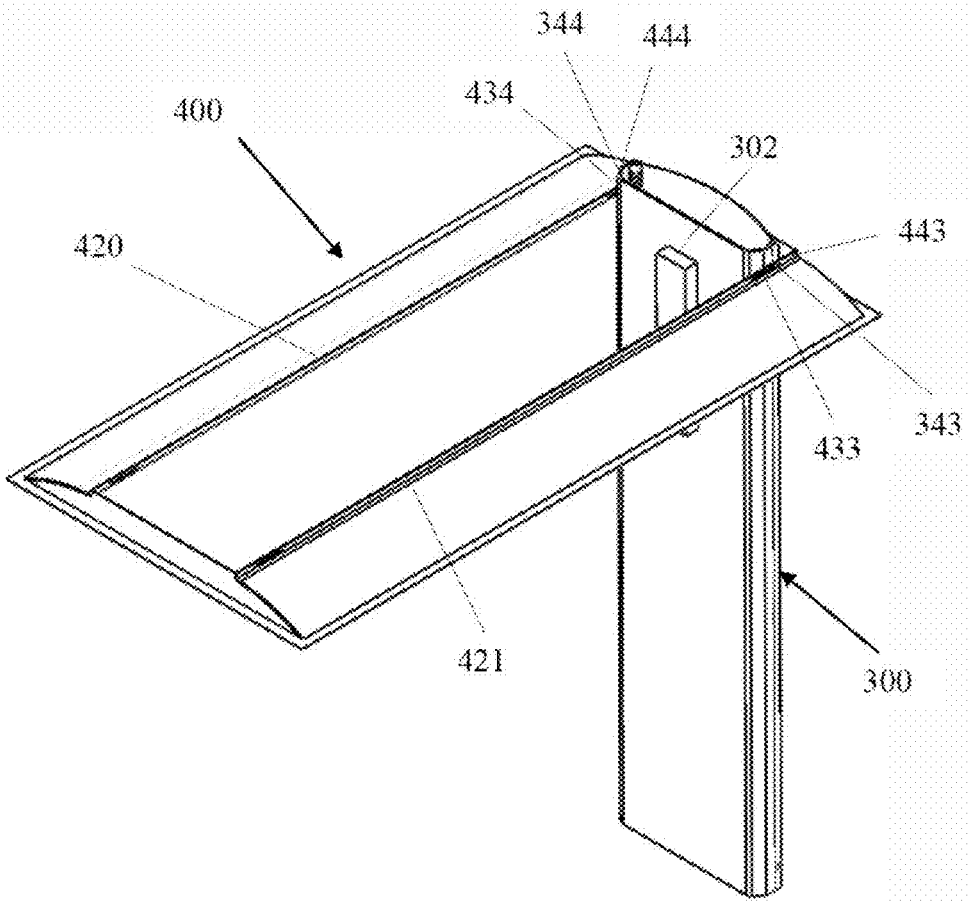
FIG. 12 is an LED light engine with one end hung on a troffer base mount.
Figure 13:
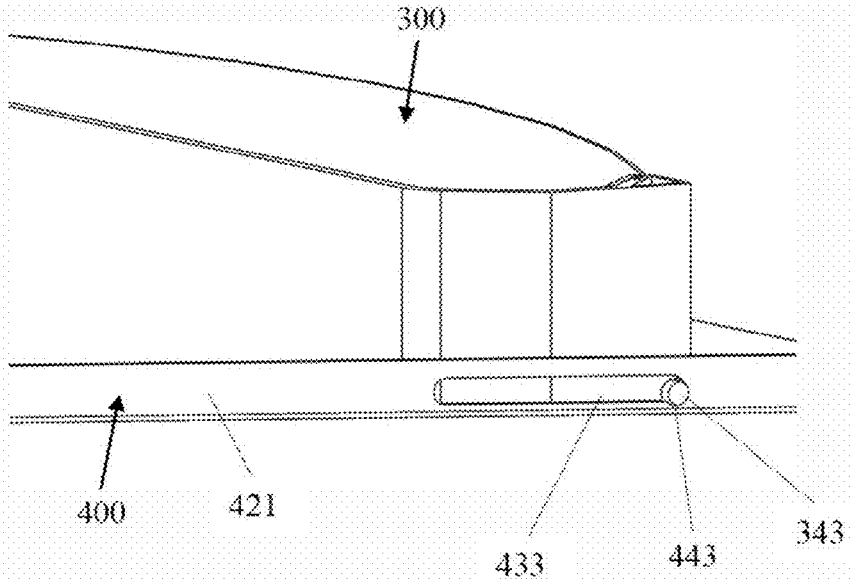
FIG. 13 is an expanded view of a part of the LED light engine hung on a troffer base mount in FIG. 12.

FIG. 12 shows the LED light engine 300 with one end hung on the troffer base mount 400. FIG. 13 is an expanded view of FIG. 12. Referring to FIGS. 12 and 13, when an installer tries to hang one end of the LED light engine 300 on the troffer base mount 400, she or he first sets the LED light engine 300 vertically with the pins 343 and 344 on the LED light engine 300 in upper position and then moves it upwards close to the elongated slots 433 and 434. Because of the elongated slot structure, the pins 343 and 344 can be easily moved into the elongated slots 433 and 434, respectively. As shown, the LED light engine 300 is hung single-ended on the troffer base mount 400 through the pins 343 and 344 that are coupled into the through holes 443 and 444 at the end of the elongated slots 433 and 434. The external driver 302 is so close to the elongated slots 433 and 434 with a short distance to reach AC wires on the ceiling that the installer can readily make a proper wire connection between the external driver 302 and the AC mains.

Figure 14:
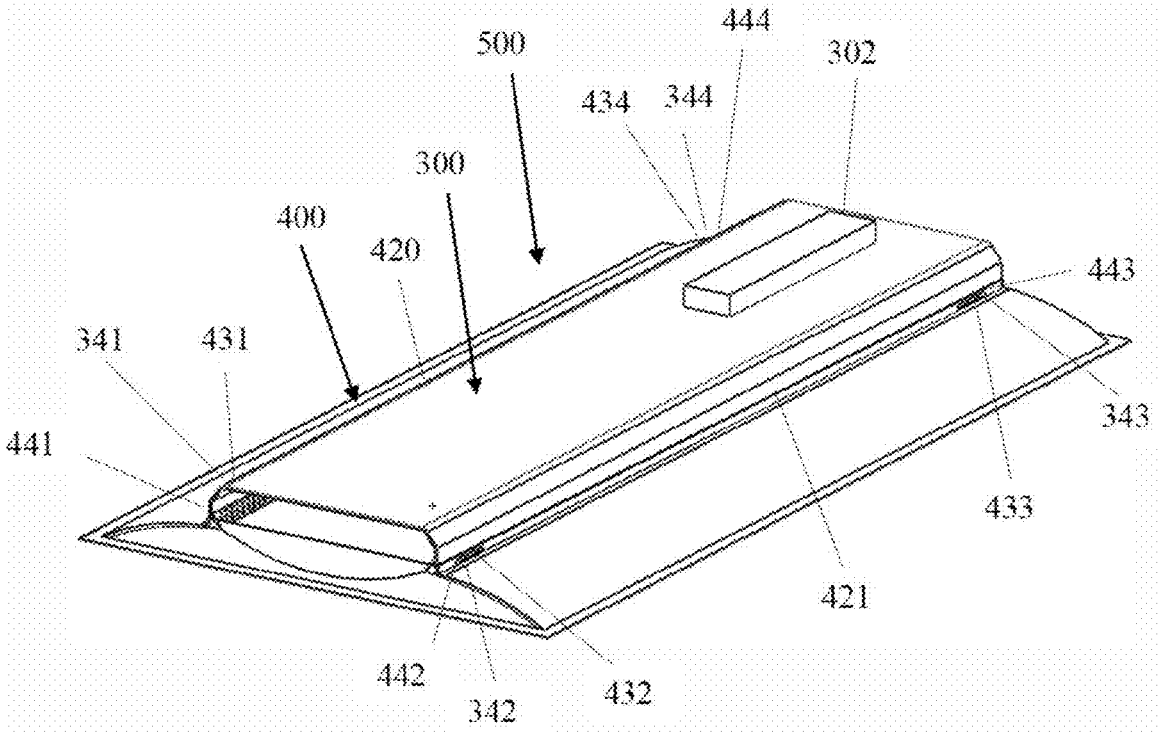
FIG. 14 is an LED troffer in a normal service position according to the present invention.
Figure 15:
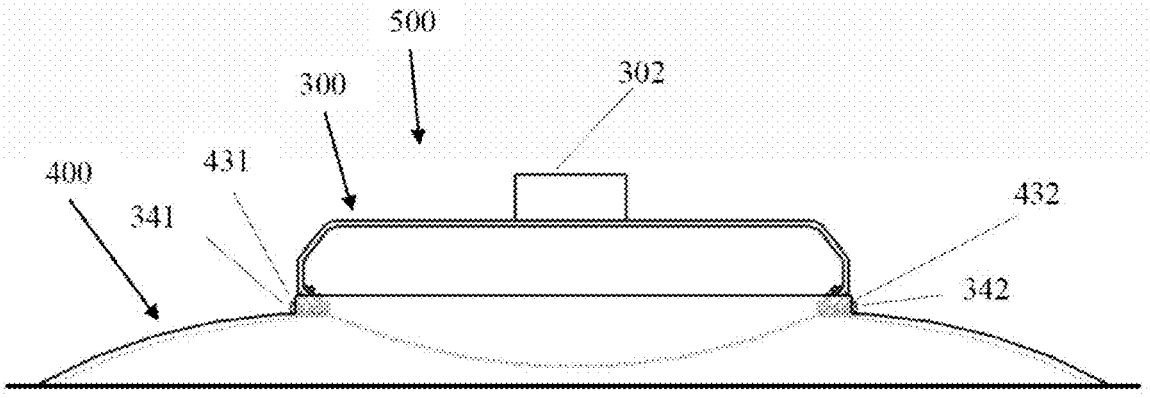
FIG. 15 is a front view of an LED troffer according to the present invention.
Figure 16:
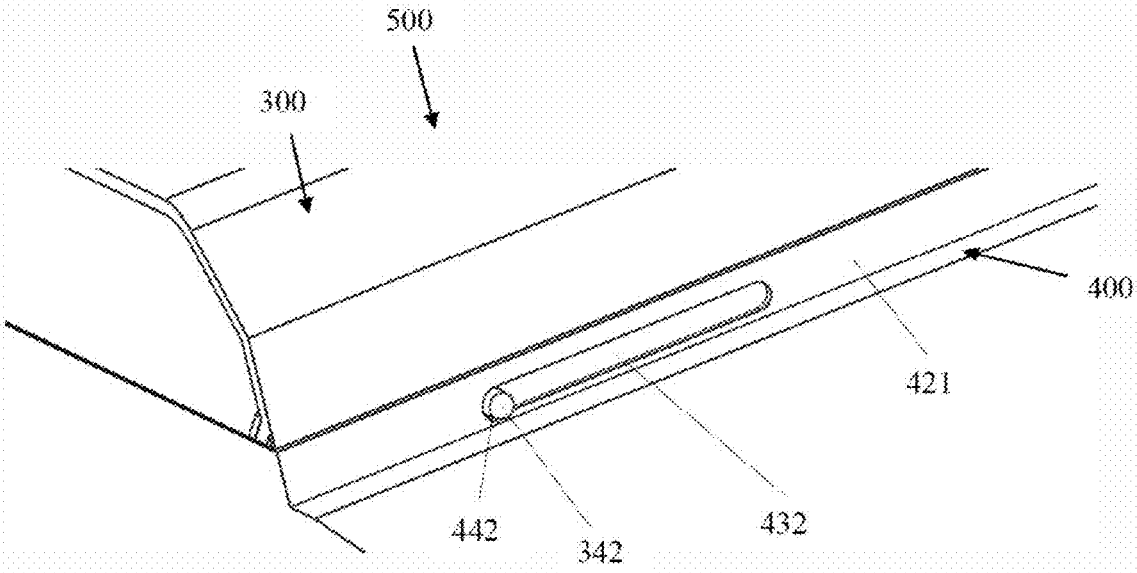
FIG. 16 is a securing mechanism used to connect an LED light engine with a troffer base mount.
Figure 17:
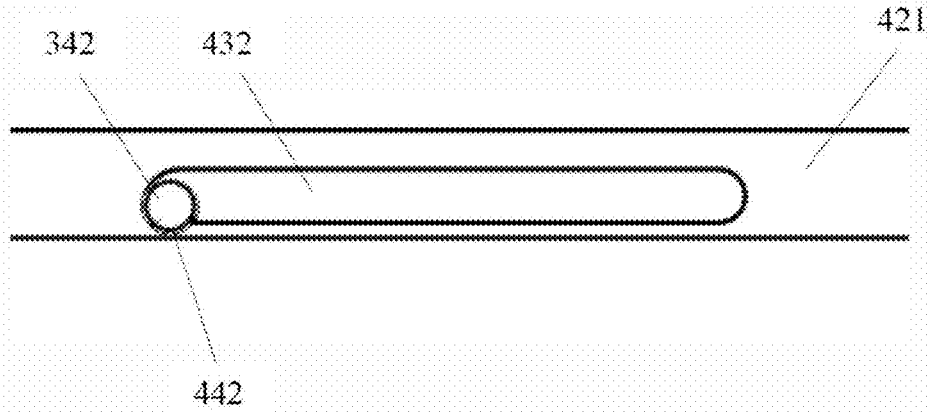
FIG. 17 is an expanded view of a securing mechanism of an LED light engine in FIG. 16.

FIG. 14 is an LED troffer in the normal operating position according to the present invention. FIG. 15 is a front view of the LED troffer 500. Referring to FIGS. 14 and 15, the LED troffer 500 comprises the LED light engine 300 on top of the troffer base mount 400. Referring to FIGS. 14-17, the LED light engine 300 originally hung vertically on the troffer base mount 400 is raised to the horizontal position. Just before being moved to the final position, the pins 341 and 342 on the LED light engine 300 are first compressed in so that the side surfaces 314 (in FIGS. 6 and 8) and 315 (in FIGS. 6 and 7) of the LED light engine 300 are respectively flush with the vertical walls 420 and 421 of the troffer base mount 400. Once the pins 341 and 342 respectively enter the elongated slots 431 and 432, the springs in the spring-loaded pins are released such that the pins 341 and 342 protrude outwards to respectively couple into the elongated slots 431 and 432, thus being secured in the through holes 441 and 442 at the end of the elongated slots 431 and 432, respectively.

Figure 18:
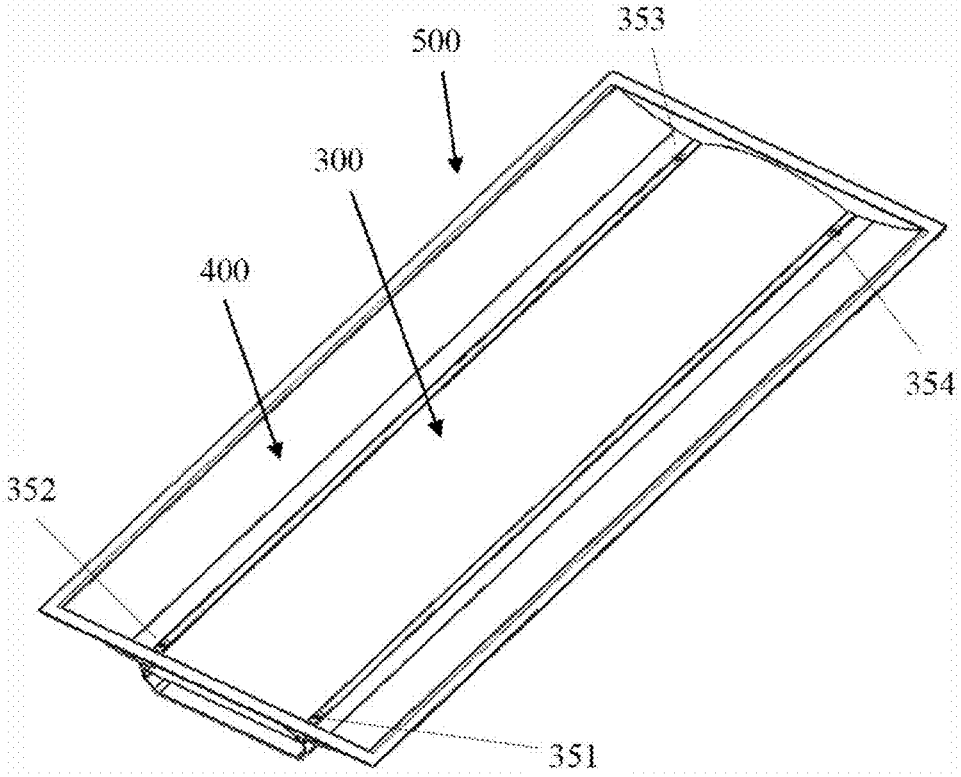
FIG. 18 is a bottom perspective view of an LED troffer.

FIG. 18 shows the LED troffer 500 from the bottom side. The four access slots 351, 352, 353, and 354 relative to the four pins 341, 342, 343, and 344 are shown whereas the four pins 341, 342, 343, and 344 are in the ceiling plenum space and thus will not be seen from the bottom. The four access slots 351, 352, 353, and 354, however, can be accessed by users. For cosmetic purposes, the small access slots can be easily filled with white soft foam after the installation. To remove the LED light engine 300 from the troffer base mount 400, the installer can first access and move the pin-control plates 355 (in FIG. 8) associated with the pins 341 and 342 in the access slots 351 and 352 inwards so that the end surfaces of the pins 341 and 342 are flush with the side surface portions 314 and 315 (shown in FIG. 7). In that case, that end of the LED light engine 300 can be slid out of the troffer base mount 400, leaving the other end hinged on the troffer base mount 400 such that the LED light engine 300 is hung vertically for retrofit work. Repeat the process at the other end for the pins 343 and 344 in the access slots 353 and 354 so that the end surfaces of the pins 343 and 344 are flush with the side surface portions 314 and 315 (shown in FIG. 7) to remove the LED light engine 300 from the troffer mount base 400.

Figure 19:
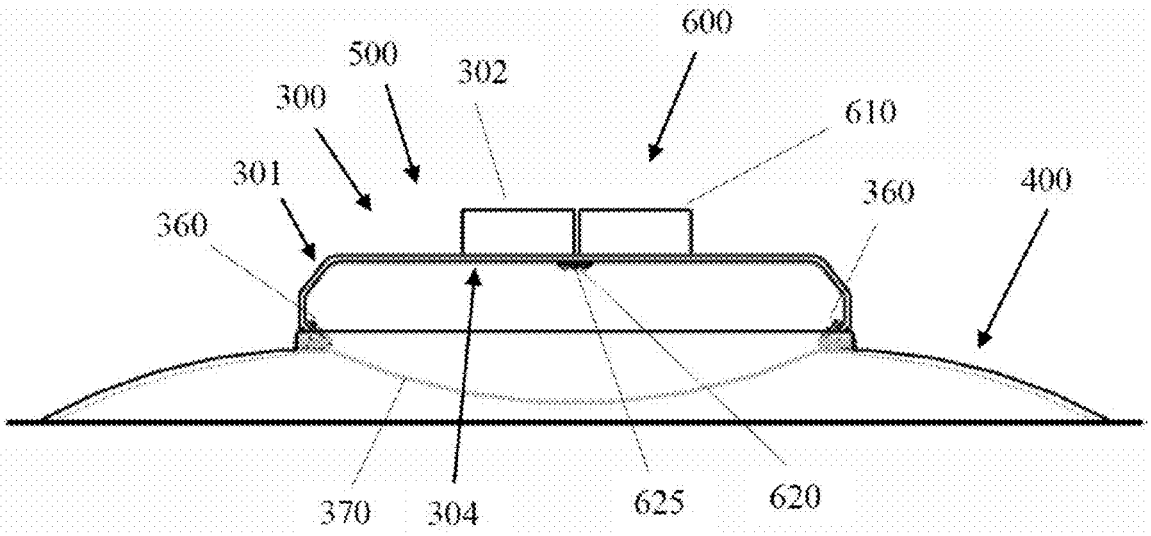
FIG. 19 is an LED normal/emergency light-integrated troffer.

As for addition of emergency lighting systems in the normal LED troffer applications, this invention uses a designated emergency light integrated with the normal light with a self-contained power source, completely different from a conventional approach that incorporates an emergency lighting system in a normal light using complicated UL 1008 automatic emergency transfer switches and a load control relay under UL 924. Although the LED troffer according to the present invention has enough space to make such an arrangement, for simplicity and low-cost considerations, the invention uses self-contained battery pack emergency lights, sometimes called unit equipment. These units are listed under UL 924 and contain a power source (usually a battery), a charger, and a load control relay. The unit is connected to normal power, which provides charging current for the battery. When normal power fails, the load control relay energizes the load. When normal power returns, the load is disconnected. The invention uses similar unit equipment integrated in the troffer such that the emergency light sources are completely concealed in the recessed troffer, which is more aesthetically pleasing than conventional car-headlight battery pack. FIG. 19 demonstrates such an arrangement. An LED emergency light-integrated troffer 600 comprises a unit equipment 610 comprising a battery pack, a charger, and a load control relay; an LED light strip 620 used when AC power is unavailable; and a standard LED troffer 500 comprising an LED light engine 300 and a troffer base mount 400. The LED light strip 620 with a plurality of LEDs 625 thereon, facing the light exit window 370, is mounted on the reflector 304 of the LED module 301, preferably in the central position as shown. Because part of the photons emitted from the side-mounted LEDs 360 under normal power operation will more or less strike the plurality of the LEDs 625 and reduce optical efficiency, the plurality of LEDs 625 are preferably high-brightness ones so that fewer LEDs and single-row linear array may be used. As mentioned above, the LED troffer 500 has a retrofittable structure that enables an installer to readily not only mount the LED light engine 300 on top of the troffer base mount 400 from the bottom side but also hang one end of the LED light engine 300 on the troffer base mount 400 for retrofit. Taking advantages of this feature, an emergency light inspector can readily inspect, test, and maintain the LED emergency light-integrated troffer 600 at the ceiling location to ensure they are in proper working conditions at all times. This will not only meet requirements of emergency lighting regulations but also dramatically reduce total lifetime cost of ownership.

Figure 20:
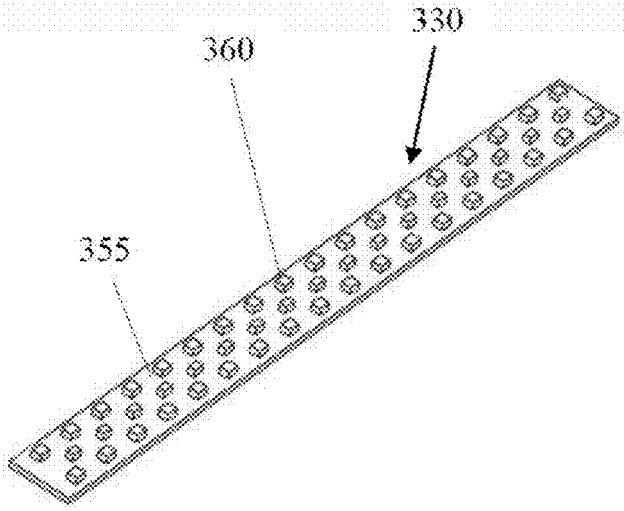
FIG. 20 is an LED light strip used as side-mounted light sources in an LED module under normal power operation.

FIG. 20 is an LED light strip used as side-mounted light sources under normal power operation. As shown, an elongated LED light strip 330 comprises an LED PCB 355 and a plurality of LEDs 360 mounted thereon. The plurality of LEDs 360 used may have different emission spectrum but of the same size, say 3528 type. The plurality of LEDs 360 may be of one type of dedicated white LEDs having a CCT from 2,700 to 6,000 K. As mentioned above, RGB color mixing is promising in decorative lighting applications in which more colorful light is desired. In this case, a plurality of RGB LEDs may be used in the LED light strip 330. The LED module according to the present invention is capable of seamlessly smoothing out colorful light emissions such that no color shadows can be seen. By varying the intensities of the individual red, green, and blue light sources, any colorful light emissions that human eyes can perceive can be obtained. For demonstration purpose, the length of the LED PCB is shorter than that of the real one, so as in FIGS. 21, 22, and 23.

Figure 21:
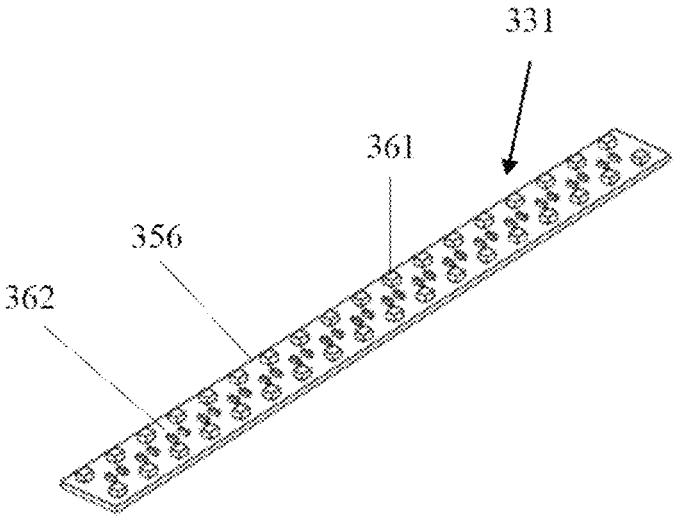
FIG. 21 is an LED light strip used as side-mounted light sources in an LED module when a tunable CCT is needed under normal power operation.
Figure 22:
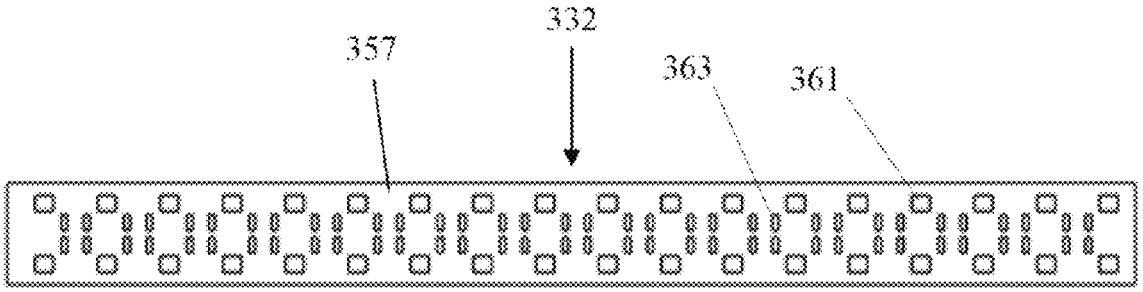
FIG. 22 is another embodiment of an LED light strip used as side-mounted light sources in an LED module when a tunable CCT is needed under normal power operation.
Figure 23:
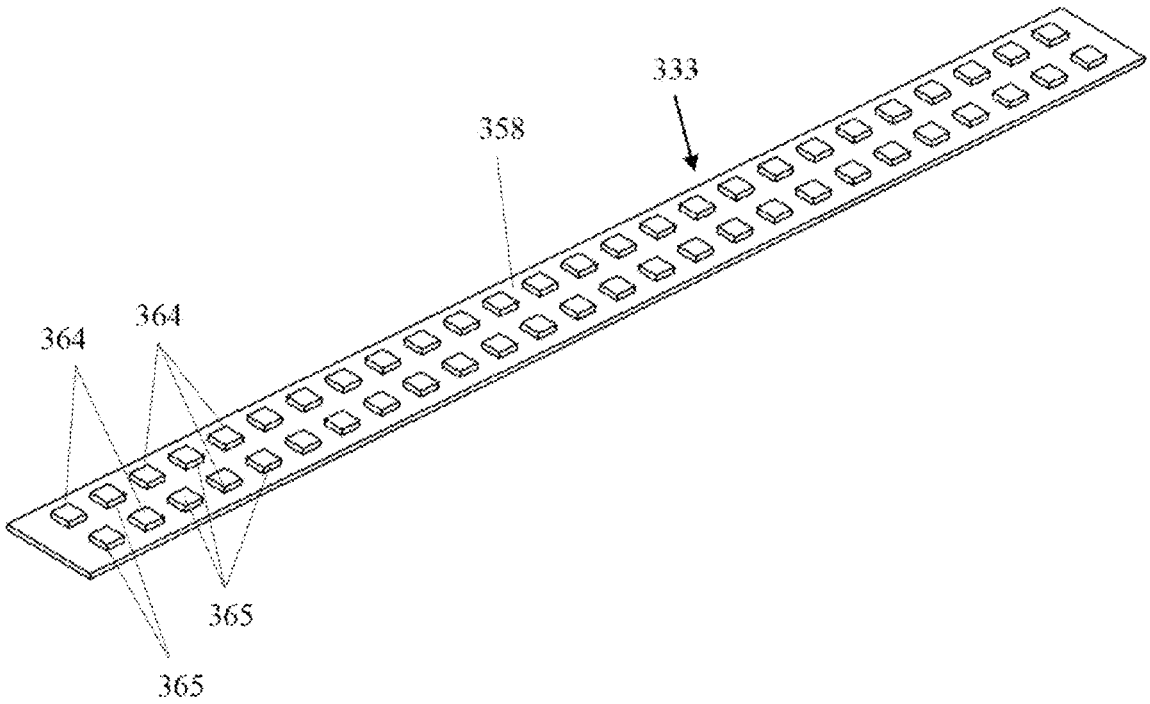
FIG. 23 is another embodiment of an LED light strip used as side-mounted light sources in an LED module when two different whites LEDs are used in a tunable CCT application.

FIGS. 21 and 22 show LED light strips 331 and 332 used as side-mounted light sources when tunable CCT is needed under normal power operation. As shown in FIG. 21, the LED light strip 331 comprises a first type of the white LEDs 361 having a CCT at 6,200±300 K and a second type of LEDs 362 having a saturated color at a peak wavelength from 583 to 586 nm, mounted on an LED PCB 356. The LEDs 361 of the first type are arranged in two rows, and every four consecutive LEDs 361 of the first type from the two rows encircle four LEDs 362 of the second type to have CCTs tunable from 2,700 to 6,000 K, depending on a ratio of electric currents supplied to the two types of LEDs. FIG. 22 has a similar structure except that four relatively smaller second type of LEDs 363 are surrounded by four first type of the white LEDs 361, mounted on an LED PCB 357 in the LED light strip 332. FIG. 23 shows an LED light strip 333 used as side-mounted light sources when tunable CCT is needed under normal power operation, wherein two kinds of phosphor coated white LEDs, one cool white and the other warm white, are used to mix the light emissions with different ratios to come up with desired CCTs. A plurality of LEDs mounted on an LED PCB 358 in the LED light strip 333 comprise a first type of white LEDs 364 having a CCT at 5,700±300 K and a second type of white LEDs 365 having a CCT at 2,700±300 K, and wherein the white LEDs 364 of the first type are interlaced two-dimensionally with the white LEDs 365 of the second type, no matter how many rows there are. As shown, there is one first type of white LEDs 364 arranged in between every two second type of white LEDs 365, or vice versa. In two-row application, if the first white LED in the first row is of the first type, then the first white LED in the second row is of the second type. They are not necessarily aligned collinearly. Although only two rows of the plurality of LEDs are shown in FIG. 23, there may be one row, three rows, or more rows in this application.

Figure 24:
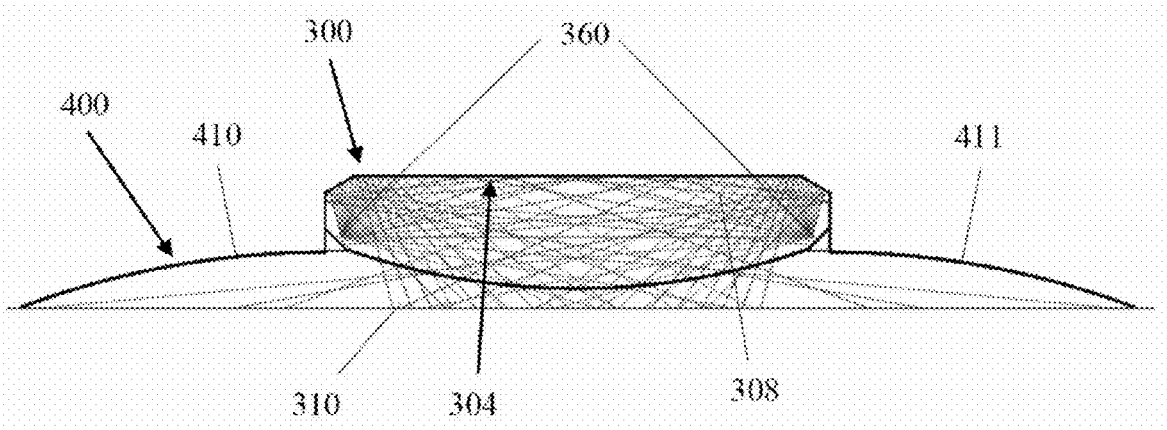
FIG. 24 is ray tracing results of an LED troffer in one embodiment according to the present invention.
Figure 25:
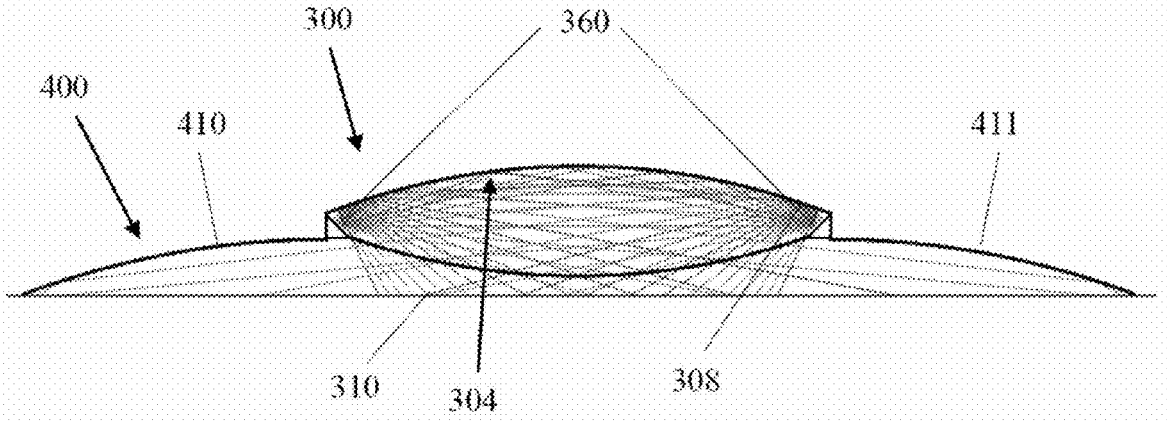
FIG. 25 is ray tracing results of an LED troffer in another embodiment according to the present invention.

FIG. 24 is ray tracing results when the LED module 301 is normally mounted on top of the troffer base mount 400. The results are the same as in FIG. 9 except that the two side reflective portions 410 and 411 on the troffer base mount 400 are included. FIG. 25 is similar simulation results as in FIG. 24 except that the reflector 304 (in FIG. 6) has a concave shape.

Whereas preferred embodiments of the invention have been shown and described, it will be realized that alterations, modifications, and improvements may be made thereto without departing from the scope of the following claims. Another readily retrofittable mechanism in an LED troffer or luminaire using various kinds of combinations to accomplish the same or different objectives could be easily adapted for use from the present invention. Accordingly, the foregoing description and attached drawings are by way of example only, and are not intended to be limiting.

What is claimed is:

1. An LED module, comprising:

a body having an internal surface comprising two side surface portions and two flat mount surface portions respectively connected to the two side surface portions:

a reflector on the internal surface of the body outside the two flat mount surface portions, said reflector comprising two vertical reflectors on the two side surface portions, two angled side reflectors respectively connected to the two vertical reflectors, and a top reflector connected in between the two angled side reflectors, wherein the two flat mount surface portions are respectively at an angle greater than 90° but less than 180° relative to the two vertical reflectors;

an LED light strip mounted on each of the two flat mount surface portions, facing the reflector, said LED light strip having a plurality of LEDs thereon; and a light exit window between the two flat mount surface portions, wherein the internal surface of the body and the light exit window define an interior cavity symmetric with respect to a vertical plane passing through a center line of the internal surface.

2. The LED module of claim 1, wherein said reflector has a concave shape.

3. The LED module of claim 1, wherein the two flat mount surface portions are respectively at an angle greater than 0° but less than 90° relative to said vertical plane.

4. The LED module of claim 1, wherein said reflector comprises a diffuser with a white reflective material having 8% absorption or less.

5. The LED module of claim 1, wherein said light exit window comprises a diffuser.

6. The LED module of claim 1, wherein said light exit window has diffraction gratings thereon.

7. The LED module of claim 1, wherein said light exit window comprises prismatic lens structures.

8. The LED module of claim 1, wherein the plurality of LEDs on the LED light strip on each flat mount surface portion comprise a first type of LEDs having a CCT at 6,200±300 K and a second type of LEDs having a saturated color at a peak wavelength from 583 to 586 nm, and wherein the LEDs of the first type are arranged in two rows, and every four consecutive LEDs of the first type from the two rows encircle two LEDs of the second type.

9. The LED module of claim 1, wherein the plurality of LEDs on the LED light strip on each flat mount surface portion comprise a first type of white LEDs having a CCT at 6,200±300 K and a second type of LEDs having a saturated color at a peak wavelength from 583 to 586 nm, and wherein the white LEDs of the first type are arranged in two rows, and every four consecutive white LEDs of the first type from the two rows encircle four LEDs of the second type.

10. The LED module of claim 1, wherein the plurality of LEDs on the LED light strip on each flat mount surface portion are white LEDs having a CCT from 2,700 to 6,000 K.

11. The LED module of claim 1, wherein the plurality of LEDs on the LED light strip on each flat mount surface portion comprise a first type of white LEDs having a CCT at 5,700±300 K and a second type of white LEDs having a CCT at 2,700±300 K, and wherein the LEDs of the first type are interlaced with the LEDs of the second type.

12. The LED module of claim 1, wherein the plurality of LEDs on the LED light strip on each flat mount surface portion are RGB LEDs.

13. The LED module of claim 1, wherein the top reflector further comprises an LED light strip, facing the light exit window, said LED light strip having at least one LED thereon.

14. An LED troffer, comprising:

a base mount comprising two opposite side reflective portions and two opposite vertical reflective portions, wherein the two side reflective portions and the two vertical reflective portions are connected to form an upper first opening and a lower second opening, and the first opening is smaller than the second opening;

an LED module connected to the small opening of the base mount, the LED module comprising:

a body having an internal surface comprising two side surface portions and two flat mount surface portions respectively connected to the two side surface portions;

a reflector on the internal surface of the body outside the two flat mount surface portions;

an LED light strip mounted on each of the two flat mount surface portions, facing the reflector, said LED light strip having a plurality of LEDs thereon; and a light exit window between the two flat mount surface portions, wherein the internal surface of the body and the light exit window define an interior cavity symmetric with respect to a vertical plane passing through a center line of the internal surface.

15. The LED troffer of claim 14, wherein said reflector of the LED module has a concave shape.

16. The LED troffer of claim 14, wherein the two flat mount surface portions of the LED module are respectively at an angle greater than 0° but less than 90° relative to said vertical plane.

17. The LED troffer of claim 14, wherein said reflector of the LED module comprises two vertical reflectors on the two side surface portions, two angled side reflectors respectively connected to the two vertical reflectors, and a top reflector connected in between the two angled side reflectors, and wherein the two flat mount surface portions are respectively at an angle greater than 90° but less than 180° relative to the two vertical reflectors.

18. The LED troffer of claim 14, wherein the body of the LED module further comprises two spring-loaded pins on each of two outer sides of the body, wherein the pins, compressible to be flush with the outer sides, protrude outwards when not compressed; and each of said two opposite side reflective portions of the base mount comprises a vertical wall extending from a top edge thereof and two elongated slots on the vertical wall; and wherein the LED module is mounted and secured on top of the base mount by aligning the pins with the elongated slots so that the pins protrude into the elongated slots.

19. The LED troffer of claim 18, wherein the body of the LED module further comprises two horizontal surfaces respectively connected and substantially perpendicular to said two outer sides of the body, and wherein each of the two horizontal surfaces comprises two access slots, wherein the two spring-loaded pins on each of the outer sides are accessible through the two access slots respectively to be compressed to disengage the pins from the elongated slots on the base mount.

20. The LED troffer of claim 14, wherein the body of the LED module further comprises two spring-loaded pins on each of two outer sides of the body, wherein the pins, compressible to be flush with the outer sides, protrude outwards when not compressed; and each of said two opposite side reflective portions of the base mount comprises a vertical wall extending from a top edge thereof and two elongated slots, each of two elongated slots further connected to a through hole on the vertical wall; and wherein the LED module is mounted and secured on top of the base mount by aligning the pins with the through holes so that the pins protrude into the through holes.

21. The LED troffer of claim 20, wherein the body of the LED module further comprises two horizontal surfaces respectively connected and substantially perpendicular to said two outer sides of the body, and wherein each of the two horizontal surfaces comprises two access slots, wherein the two spring-loaded pins on each of the outer sides are accessible through the two access slots respectively to be compressed to disengage the pins from the through holes on the base mount.

22. The LED troffer of claim 17, wherein the top reflector of the LED module further comprises an LED light strip, facing the light exit window, said LED light strip having at least one LED thereon.

23. The LED troffer of claim 22, wherein the LED module further comprises an emergency power backup system powering the LED light strip mounted on the top reflector.

24. The LED troffer of claim 14, wherein said reflector of the LED module comprises a diffuser with a white reflective material that has 8% absorption or less.

25. The LED troffer of claim 14, wherein said light exit window of the LED module comprises a diffuser.

26. The LED troffer of the claim 14, wherein said light exit window has diffraction gratings thereon.

27. The LED troffer of claim 14, wherein said light exit window of the LED module comprises prismatic lens structures.

28. The LED troffer of claim 14, wherein the plurality of LEDs on the LED light strip on each flat mount surface portion comprise a first type of LEDs having a CCT at 6,200±300 K and a second type of LEDs having a saturated color at a peak wavelength from 583 to 586 nm, and wherein the LEDs of the first type are arranged in two rows, and every four consecutive LEDs of the first type from the two rows encircle two LEDs of the second type.

29. The LED troffer of claim 14, wherein the plurality of LEDs on the LED light strip on each flat mount surface portion comprise a first type of white LEDs having a CCT at 6,200±300 K and a second type of LEDs having a saturated color at a peak wavelength from 583 to 586 nm, and wherein the white LEDs of the first type are arranged in two rows, and every four consecutive white LEDs of the first type from the two rows encircle four LEDs of the second type.

30. The LED troffer of claim 14, wherein the plurality of LEDs on the LED light strip on each flat mount surface portion are white LEDs having a CCT from 2,700 to 6,000 K.

31. The LED troffer of claim 14, wherein the plurality of LEDs on the LED light strip on each flat mount surface portion comprise a first type of white LEDs having a CCT at 5,700±300 K and a second type of white LEDs having a CCT at 2,700±300 K, and wherein the LEDs of the first type are interlaced with the LEDs of the second type.

32. The LED troffer of claim 14, wherein the plurality of LEDs on the LED light strip on each flat mount surface portion are RGB LEDs.

* * * * *